US009791226B1

(12) United States Patent
Bozzo

(10) Patent No.: US 9,791,226 B1
(45) Date of Patent: Oct. 17, 2017

(54) BOLT ACTION SLIDE CONVERSION DEVICE

(71) Applicant: Nathan David Bozzo, San Martin, CA (US)

(72) Inventor: Nathan David Bozzo, San Martin, CA (US)

( * ) Notice: Subject to any disclaimer, the term of this patent is extended or adjusted under 35 U.S.C. 154(b) by 0 days.

(21) Appl. No.: 15/379,913

(22) Filed: Dec. 15, 2016

Related U.S. Application Data

(60) Provisional application No. 62/324,925, filed on Apr. 20, 2016.

(51) Int. Cl.
*F41A 3/72* (2006.01)
*F41A 9/52* (2006.01)
*F41C 3/00* (2006.01)

(52) U.S. Cl.
CPC *F41A 9/52* (2013.01); *F41A 3/72* (2013.01); *F41C 3/00* (2013.01)

(58) Field of Classification Search
CPC .... F41A 3/72; F41A 9/52; F41A 35/06; F41A 7/02; F41A 7/00; F41A 17/30; F41C 33/0281; F41C 33/08
See application file for complete search history.

(56) References Cited

U.S. PATENT DOCUMENTS 4,055,015 A * 10/1977 Musgrave ..... F41A 19/37 224/911
4,823,671 A * 4/1989 Buryta ..... F41A 3/72 42/106
8,789,306 B1 * 7/2014 Mazzoni ..... F41C 33/04 42/71.01
9,500,439 B1 * 11/2016 Dietrich ..... F41A 3/72
9,664,471 B1 * 5/2017 Curry ..... F41A 19/30
2005/0268518 A1 * 12/2005 Pikielny ..... F41C 33/0209 42/90
2007/0163164 A1 * 7/2007 Avrahami ..... F41C 33/0227 42/87
2009/0001117 A1 * 1/2009 Rassias ..... F41C 33/0236 224/673
2010/0095576 A1 * 4/2010 Johns ..... F41A 21/00 42/108
2010/0219216 A1 * 9/2010 Clark ..... F41C 33/0281 224/243
2010/0263255 A1 * 10/2010 Harris ..... F41C 27/00 42/90
2011/0225865 A1 * 9/2011 Williams ..... F41C 7/02 42/90

(Continued)

*Primary Examiner* — Derrick R Morgan

(57) ABSTRACT

A bolt-action conversion device includes a slide clamp having a longitudinal cavity, a first pin hole, and a receiver in a direction orthogonal to the longitudinal cavity and substantially adjacent to a forward end of the slide clamp. The device also includes a locking plate having a second pin hole. A body portion of the locking plate has a narrow dimension and a broad dimension relative to the narrow dimension. When the locking plate is inserted into the receiver of the slide clamp with the first pin hole and the second pin hole aligned, an opening is formed between an upper surface of the locking plate and an internal surface of the longitudinal internal cavity. The longitudinal cavity accepts a slide of a firearm such that the opening is aligned with the barrel and at least a portion of the locking plate is aligned with a frame.

16 Claims, 8 Drawing Sheets

(56) References Cited

U.S. PATENT DOCUMENTS

| | | | | |
|---|---|---|---|---|
| 2012/0131829 | A1* | 5/2012 | Fistikchi | F41A 3/72 42/1.06 |
| 2013/0000173 | A1* | 1/2013 | Green | F41A 17/64 42/70.11 |
| 2013/0111799 | A1* | 5/2013 | Lee | F41G 11/001 42/106 |
| 2014/0096429 | A1* | 4/2014 | Sandler | F41G 11/003 42/124 |
| 2014/0298703 | A1* | 10/2014 | Gale | F41C 27/00 42/71.02 |
| 2015/0053072 | A1* | 2/2015 | Bunker | F41A 35/06 89/1.4 |
| 2015/0184959 | A1* | 7/2015 | Parnell | F41A 3/72 89/1.4 |
| 2015/0316346 | A1* | 11/2015 | Brandt | F41C 23/12 42/71.02 |
| 2015/0345898 | A1* | 12/2015 | Bardy | F41C 33/0263 224/244 |
| 2017/0191795 | A1* | 7/2017 | Xia | F41C 33/0263 |
| 2017/0199008 | A1* | 7/2017 | Crawford, II | F41C 33/0281 |

* cited by examiner

BOLT ACTION SLIDE CONVERSION DEVICE

CROSS-REFERENCE TO RELATED APPLICATION

This application claims the benefit under 35 U.S.C. §119 (e) of U.S. Provisional Application 62/324,925 filed on Apr. 20, 2016, which is hereby incorporated by reference in its entirety.

TECHNICAL FIELD

The disclosure relates to the field construction and modification of firearms.

BACKGROUND

A bolt-action firearm may be operated by manually moving a slide (also referred to as a bolt) of a firearm to expose a chamber of the firearm. When the chamber is exposed, a spent cartridge may be ejected and a new cartridge may be inserted. Then the slide may be returned to an original position to close the chamber of the firearm which is then loaded.

BRIEF DESCRIPTION OF THE DRAWINGS

Various implementations of the present disclosure will be understood more fully from the detailed description given below and from the accompanying drawings of various implementations of the invention.

DETAILED DESCRIPTION

Figure 1:
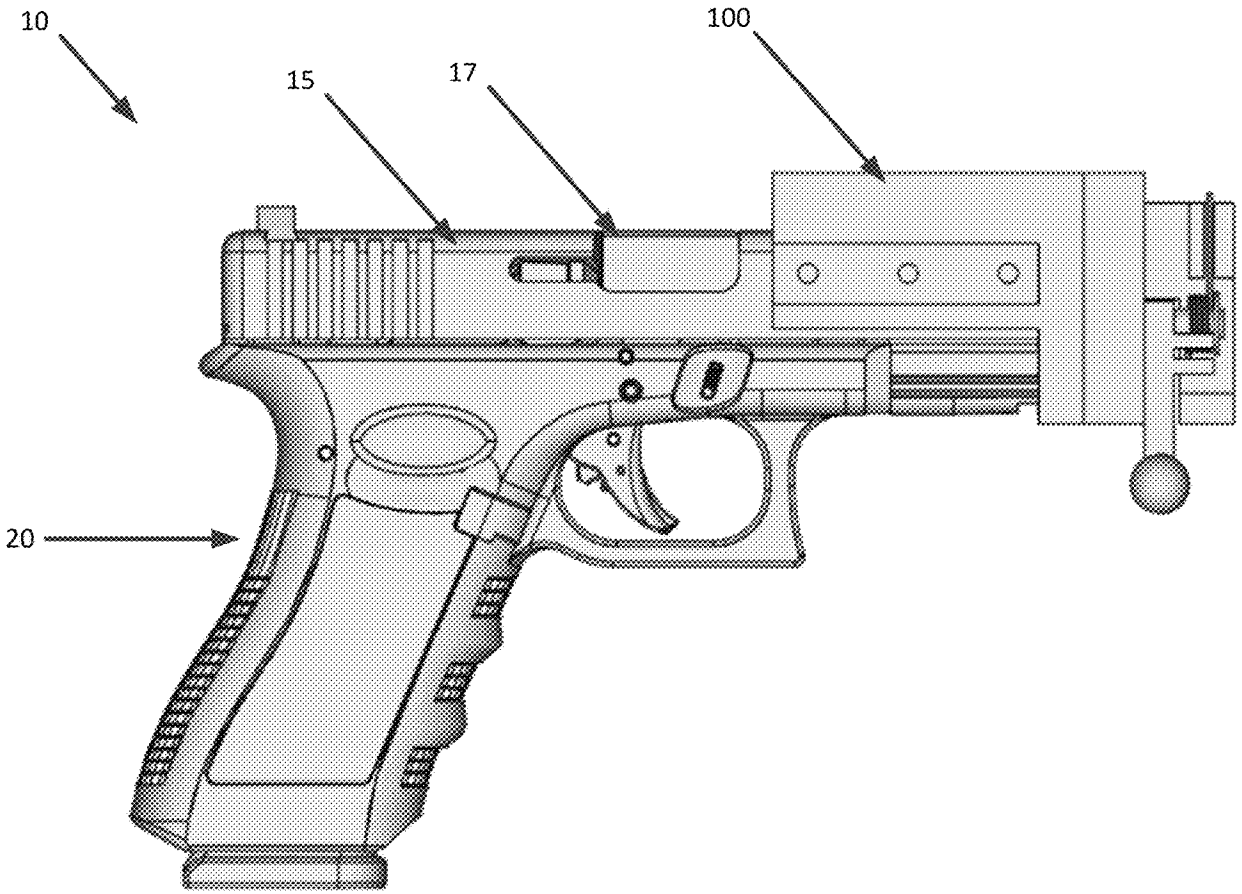
FIG. 1 depicts an example bolt-action conversion device coupled to a firearm, according to an implementation.

Various jurisdictions regulate the possession of firearms. Such restrictions may be based on a type of firearm, technical specifications of firearms, manufacturer, or other characteristics. Additionally, some individuals may prefer firearms that have specific characteristics. For example, an individual may prefer to own and use pistols, rifles, shotguns, or other types of firearms. In addition, an individual may prefer some manufacturers to others. In some situations, an individual may prefer to own or manufacture a firearm that operates with a bolt-action slide. This may be to suit an individual preference of a gun owner or may be to satisfy one or more regulations in a particular jurisdiction.

A bolt-action slide on a firearm may be used to chamber a bullet by pulling a charging handle to pull back the slide and expose an open chamber. The chamber may then receive a bullet placed into the chamber or from a magazine or other bullet source. Repositioning the charging handle to the original position chambers the bullet in the position with the barrel of the firearm.

A bolt-action slide conversation device as described herein may convert a slide of a firearm to operate as a bolt-action slide. Thus, a slide that would not function as a bolt action slide may function as a bolt action slide after the bolt-action slide conversation device is coupled to the slide. In an example, the bolt-action conversion device may prevent a firearm slide from opening the chamber of a firearm in response to a shot being fired. For instance, in a pistol, a typical slide may slide back to open the chamber of the pistol in response to firing a shot. However, when the firearm slide is coupled to the bolt-action slide conversion device, the firearm slide does not automatically open a chamber in response to firing a bullet. Instead, the chamber remains sealed. This may improve the accuracy or speed of the bullet that is fired. After the bullet is fired, a new cartridge may be loaded by pulling a charging handle to move the slide to expose the chamber.

In order to convert a slide to be a bolt-action slide, the bolt-action conversion device may use a locking plate to prevent the slide from automatically exposing the chamber when a shot is fired. The locking plate may be operatively coupled to a clamp assembly. The clamp assembly may be attached to a slide. Thus, the clamp assembly may have one or more retainers to position the locking plate at the front of a barrel of a firearm without obstructing the firing of a bullet from the muzzle of a gun. When a bullet is fired, the locking plate is in contact with the front of the firearm to stop the backward force exerted by the bullet on the slide from moving the slide.

The figures and associated description are generally described herein with reference to pistols. However, the bolt-action conversion device may also be used for rifles, shotguns, or other firearm configurations. Furthermore, the bolt-action conversion device may be used on a slide of a firearm with an attached magazine that automatically loads a cartridge when the charging handle is pulled back to expose the chamber, or may be used on a slide of a single shot firearm that may load cartridges one at a time from a source other than an attached magazine.

The following detailed description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of the claimed disclosure. However, various aspects of the disclosed implementations may be practiced in other examples that depart from these specific details. In certain instances, descriptions of well-known devices, circuits, and methods are omitted so as not to obscure the description of the present disclosure with unnecessary detail.

FIG. 1 depicts an example firearm 10 with a bolt-action conversion device 100 attached to the slide 15, as implemented in an embodiment. In the example in FIG. 1, the bolt-action conversion device 100 is attached to the slide 15 such that the slide 15 will not move relative to the frame 20 of a firearm when a bullet is fired. Accordingly, the chamber 17 of the firearm will not be opened by the force of the firing a bullet.

Figure 2:
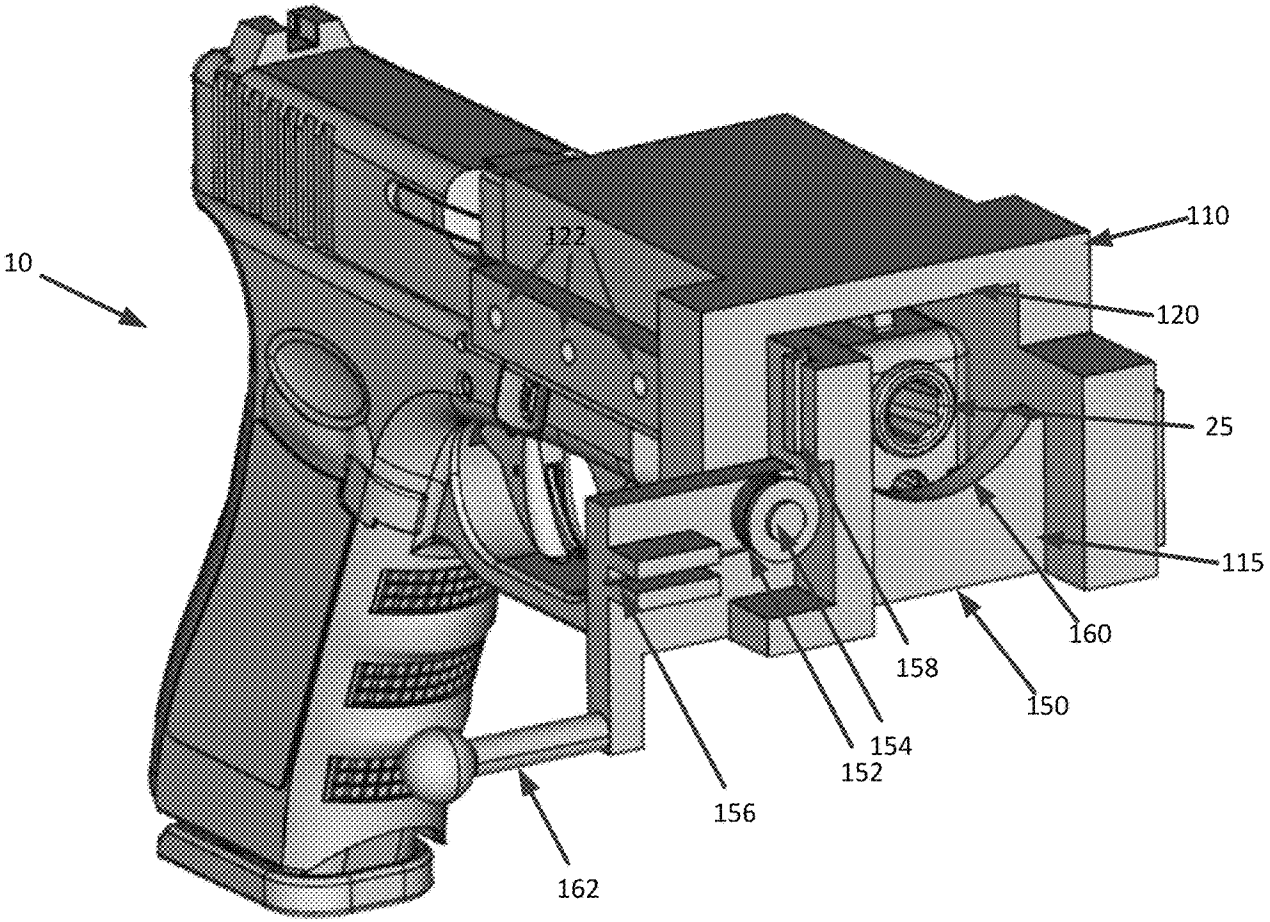
FIG. 2 depicts an example bolt-action conversion device coupled to a firearm, according to an implementation.

FIG. 2 depicts an example firearm 10 with a bolt-action conversion device 100 attached to the slide 15, as implemented in an embodiment. The bolt-action conversion device 100 includes a slide clamp 110 and a locking plate 150. The slide clamp 110 and locking plate 150 may each have a pivot pin hole that has a pivot pin 154 that connects the slide clamp 110 to the locking plate 110 and enables the locking plate 110 to rotate with respect to the slide clamp 110. The locking plate 150 may be held in a locked position by a torsion spring 152 that, when the bolt-action conversion device 100 is constructed, is disposed in a first torsion spring retainer 156 that is part of the locking plate 110 and a second torsion spring retainer 158 that is part of the slide clamp 150. The force applied by the torsion spring 152 may place the locking plate 150 in position to prevent the slide 15 from moving relative to the frame 20 of the firearm. In some embodiments, the bolt-action conversion device may operate without a torsion spring and the locking plate may be positioned manually into the receiving slots 115.

In the configuration shown in FIG. 2, the slide clamp 110 is coupled to the slide 15 of the firearm. The slide clamp 110 may have an interior surface 120 that forms a longitudinal cavity. The slide clamp 110 may be configured such that the longitudinal cavity formed by the interior surface 120 can receive the slide of a firearm. In FIG. 2, the locking plate 150 is inserted into a receiving slot 115 of the slide clamp 110. In this configuration, the locking plate 150 is positioned in front of the frame 20 of the firearm. Accordingly, the locking plate 150 prevents the slide clamp 110 from moving backward from the muzzle 25 of the firearm and the slide clamp 110 in turn prevents the slide 15 from moving to expose a chamber of the firearm. Thus, when a bullet is fired, the locking plate 150 holds the slide 15 in place. In some embodiments, a locking mechanism may be used to lock the locking plate 150 into position in the receiving slots 115.

When the locking plate 150 is inserted into the receiving slots 115 as shown in FIG. 2, an opening is formed between an upper surface 160 of the locking plate 150 and an internal surface 120 of the slide clamp 110. The slide clamp 110 and locking plate 150 may be configured such that the opening is aligned with the barrel 25 of the firearm such that neither the slide clamp 110 nor the locking plate 150 interfere with the firing of a bullet from the barrel 25 of the firearm.

As shown in FIG. 2, the slide clamp may have one or more screw holes 122 that receive one or more screws (not shown) that apply a force to couple the slide clamp 110 to the slide 15. In some embodiments, there may be fewer or additional screw holes 122 and associated screws than are shown in FIG. 2. In some embodiments, the slide clamp 110 may include one or more retaining plates on the inside surface of the slide clamp that distributes the force of the screws to couple the slide clamp 110 to the slide 15 without damaging the slide 15. In some embodiment, the retaining plates may be rubber, plastic, or another suitable material that will not damage the slide 15 while providing a secure coupling of the slide clamp 110 to the slide 15.

The locking plate 110 may have a charging handle 162 that enables bolt-action operation of the firearm. The charging handle 162 may be used to rotate the locking plate 110 about an axis defined by the pivot pin 154. When a force is applied to the charging handle 162 that exceeds a force applied by the torsion spring 152, the locking plate 150 may rotate to expose the front of the frame 20 of the firearm.

Figure 3:
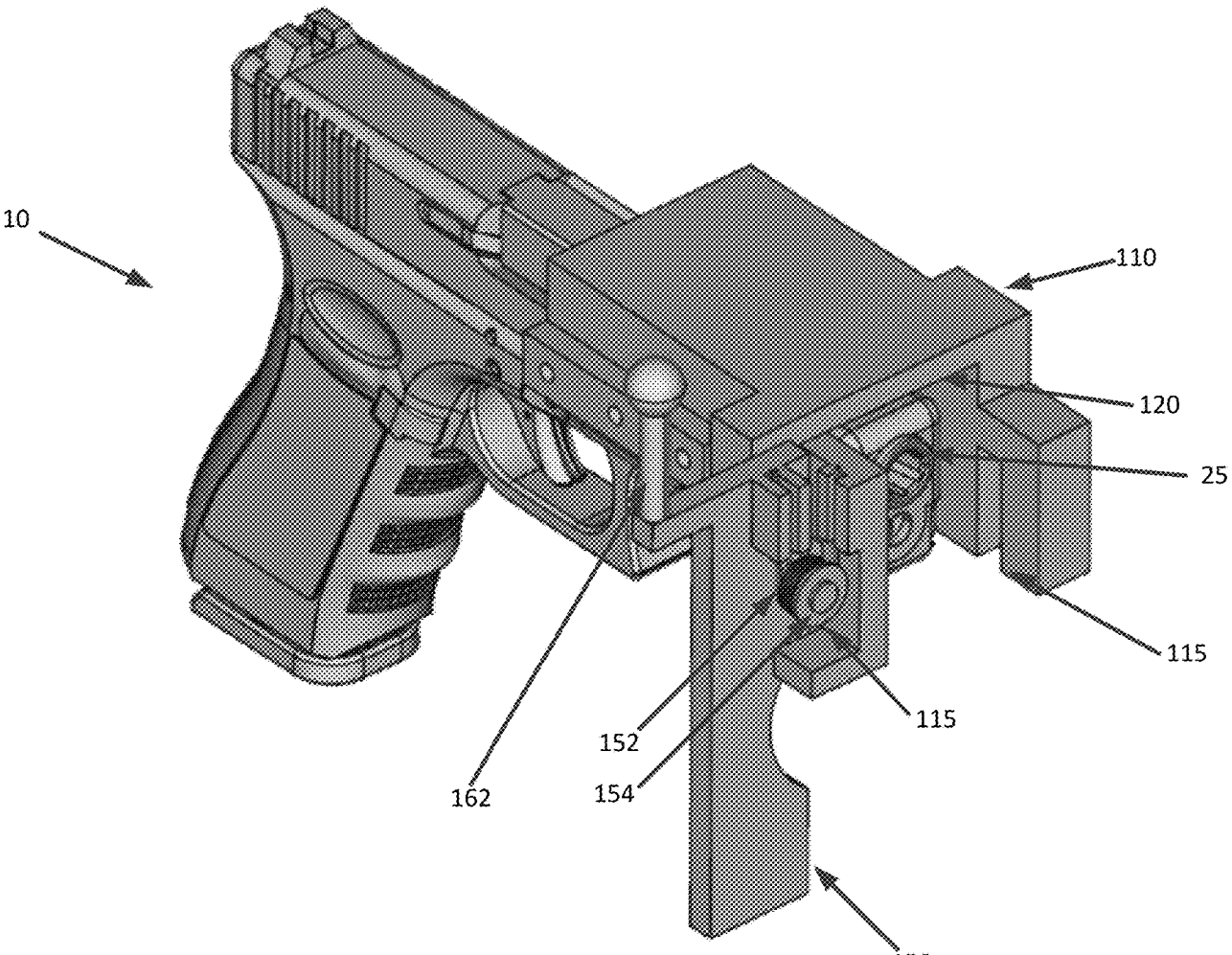
FIG. 3 depicts an example bolt-action conversion device coupled to a firearm, according to an implementation.

FIG. 3 depicts an example of a bolt-action conversion device 100 attached to the slide 15 of a firearm 10, as implemented in an embodiment. The bolt-action conversion device 100 may be the same as the bolt-action conversion device 100 described with reference to Figure As shown in FIG. 3, the locking plate 150 is rotated about the pivot pin 154. The locking plate 150 may be rotated by a force applied to the charging handle 162. In response to the force, the locking plate 150 may be removed from the receiving slots 115 of the slide clamp 110.

As shown in FIG. 3, when the locking plate 150 is rotated, the front of the frame 20 is exposed. Accordingly, the locking plate 150 is not stopping the slide clamp 110, and therefore the slide 15, from moving away from the muzzle of the firearm. Thus, a force applied on the charging handle 162 directed toward the rear of the gun will move the slide back and expose the chamber of the gun. Then a casing of the bullet may be removed and a new cartridge may be replace.

Figure 4:
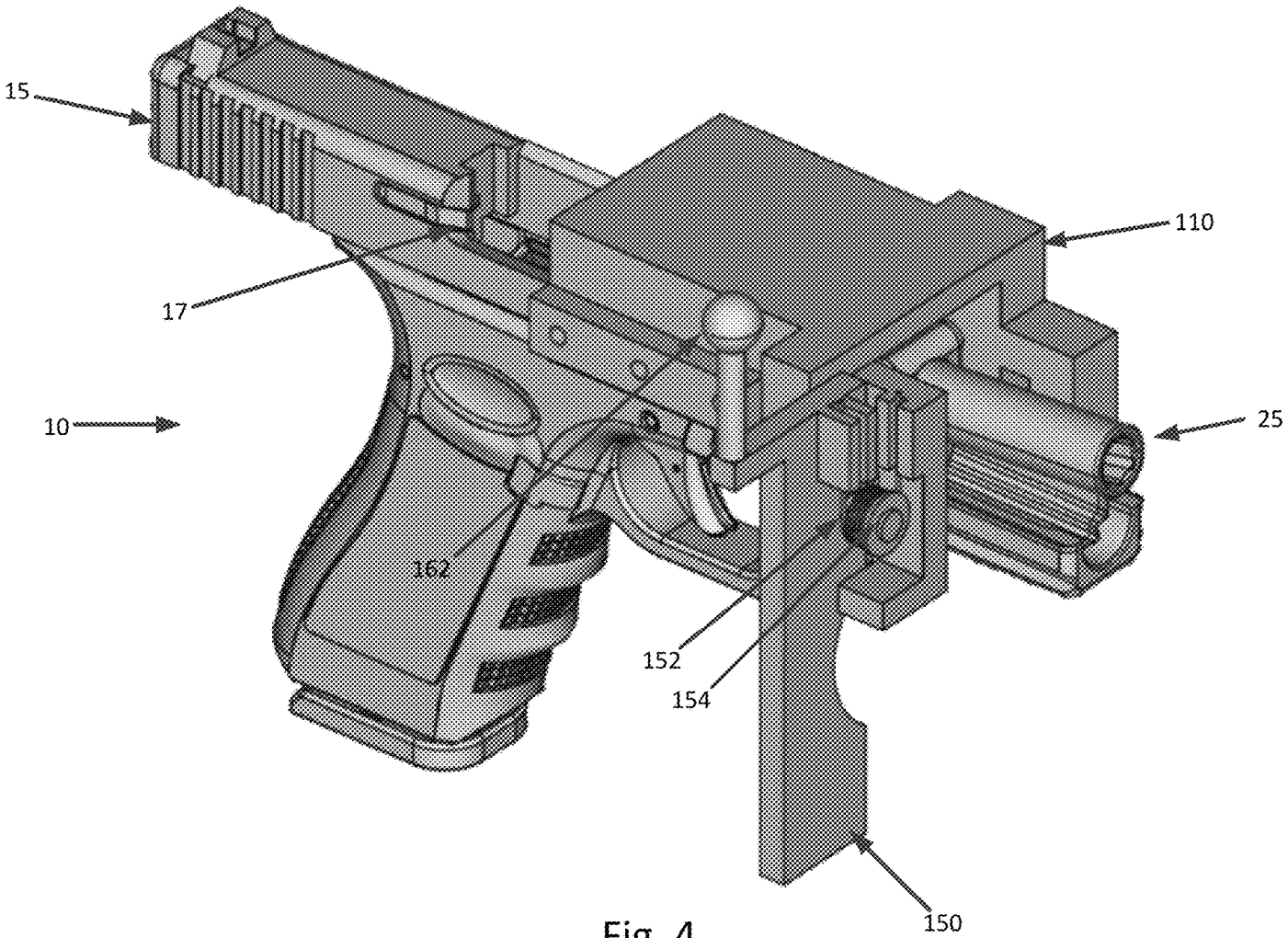
FIG. 4 depicts an example bolt-action conversion device coupled to a firearm, according to an implementation.

FIG. 4 depicts an example of a bolt-action conversion device 100 attached to the slide 15 of a firearm 10 with the chamber exposed, as implemented in an embodiment. As shown in FIG. 4, the locking plate 110 is rotated about the pivot pin 154 as discussed with reference to FIG. 3. The bolt-action conversion device 100 has been moved away from the muzzle of the firearm. When the bolt-action conversion device 100 is moved away from the muzzle, the slide 15 is pulled back and exposes a chamber 17.

After the chamber 17 is exposed, a casing may be removed or a new bullet may be loaded. The bolt-action conversion device 100 may then be moved back to the front of the firearm and the locking plate 150 may be rotated into the receiving slots 115 to chamber the bullet and prepare the firearm for firing. For example, the bolt-action conversion device 100 may be moved from the configuration shown in FIG. 4, to the configuration shown in FIG. 3, and then to the configuration shown in FIG. 2.

Figure 5:
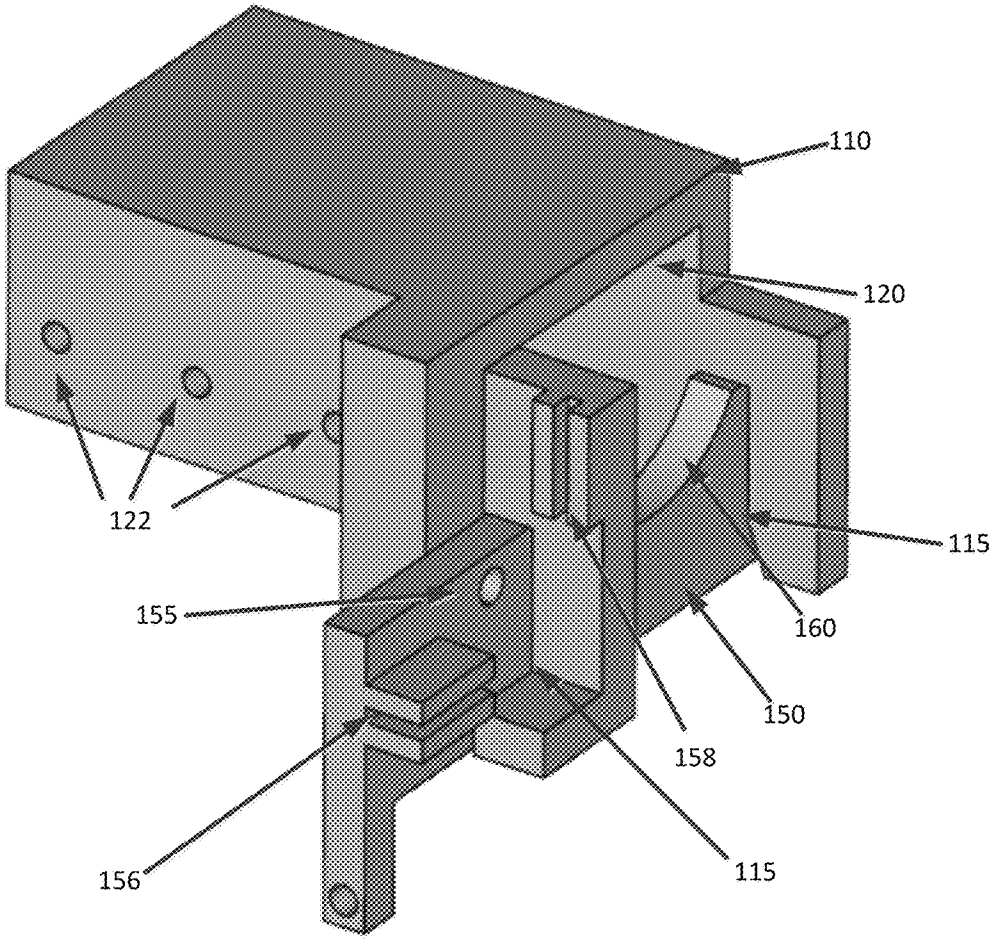
FIG. 5 depicts an example bolt-action conversion device not coupled to a firearm, according to an implementation.

FIG. 5 depicts an example of a bolt-action conversion device 100 comprising a locking plate 150 and a slide clamp 110, as implemented in an embodiment. In some embodiments, the bolt-action conversion device 100 shown in FIG. 5 may be the same or similar to the bolt-action conversion device 100 described with reference to FIG. 2, however, the bolt-action conversion device 100 shown in FIG. 5 is not coupled to a firearm slide.

The locking plate 150 may have a pivot pin hole 155 that is aligned with a pivot pin hole (not shown) of the slide clamp 110. When a pivot pin is placed into the pivot pin hole 15 while aligned with the pivot pin hole of the slide clamp 110, the pivot pin may enable the locking plate 110 to rotate with respect to the slide clamp 110 around an axis defined by the pivot pin. The locking plate 150 may have a first torsion spring retainer 156 that is part of the locking plate 150 and the slide clamp 110 may have a second torsion spring retainer 158. The torsion spring retainers may receive a torsion spring to apply a force that positions the locking plate 150 into receiving slots 115 of the slide clamp 110.

The receiving slots 115 may be rectangular slots that receive a rectangular locking plate 150 as shown in FIG. 5, or may have different shapes or dimensions. For instance, the receiving slots 115 may have a tapered lower portion. Thus the receiving slot 115 with a tapered lower portion may have an opening that is wider than the locking plate 150. This may improve the operation of the bolt-action conversion device 100 such that the locking plate 150 is easily inserted into the receiving slot 115. In some embodiments, the receiving slot may have an oval shape, or another shape to receive a locking plate 150.

When the locking plate 150 is inserted into the receiving slots 115 as shown in FIG. 5, an opening is formed between an upper surface 160 of the locking plate 150 and an internal surface 120 of the slide clamp 110. The slide clamp 110 and locking plate 150 may be configured such that the opening can be aligned with the barrel 25 of the firearm such that neither the slide clamp 110 nor the locking plate 150 would interfere with the firing of a bullet from the barrel of the firearm.

In some embodiments, the upper surface 160 of the locking plate 150 may be curved as shown in FIG. 5. The curved structure may increase a portion of the locking plate that is in contact with the frame of a firearm when the firearm is fired, while providing an opening between the upper surface 160 of the locking plate 150 and the internal surface of the slide clamp 110 that will not interfere with the firing of a firearm. In some embodiments, the upper surface 160 of the locking plate 150 may have other configurations. For instance, the upper surface 160 may be shaped to have a slot that provides an opening for the barrel of a firearm, may be flat, or may have any other shape that provides an opening between the locking plate 150 and the slide clamp 110 while the locking plate is positioned to block the slide from moving during firing of a firearm.

The slide clamp 110 may have one or more screw holes 122 that are configured to receive one or more securing screws (not shown) that couple the slide clamp 110 to a firearm slide. In some embodiments, the slide clamp 110 may include one or more retaining plates on the inside surface of the slide clamp that distributes the force of the screws to couple the slide clamp 110 to a slide. In some embodiment, the retaining plates may be rubber, plastic, or another suitable material that will not damage a slide while providing a secure coupling of the slide clamp 110 to a slide.

Figure 6:
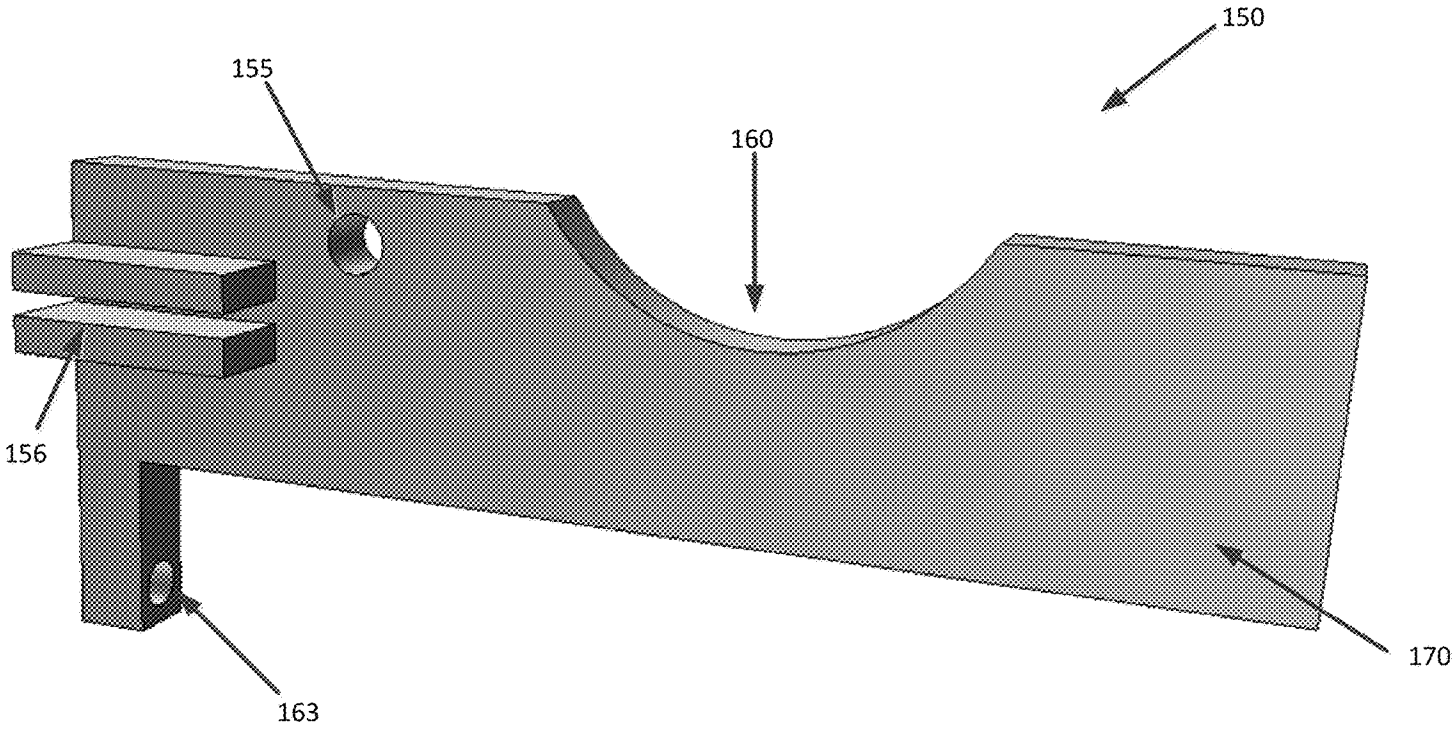
FIG. 6 depicts an example portion of a bolt-action conversion device, according to an implementation.

FIG. 6 depicts a locking plate 150 that may be coupled to a slide clamp as part of a bolt-action conversion device, according to an embodiment. The locking plate 150 may be the same or similar to the locking plate 150 described with references to bolt-action conversion devices in other Figures herein.

The locking plate 150 in FIG. 6 comprises a pivot pin hole 155, a torsion spring retainer 156, and an upper surface 160. The upper surface 160 may define a narrow dimension of the locking plate 150. A face 170 of the locking plate 150 may define a broad dimension of the locking plate 150. The broad dimension of the locking plate 150 may be configured to contact the front of a frame of a firearm when a bolt-action conversion device is coupled to the slide of the firearm. The locking plate in FIG. 6 includes an attachment position 163 to attach a charging handle to the locking plate 150. The charging handle may then be used to operate the firearm as a bolt-action firearm after a bolt-action conversion device is coupled to the firearm.

The locking plate 150 may be made of steel, aluminum, a plastic or ceramic composite material, or any other suitable material. In addition to the structure shown, in some embodiments, the locking plate 150 may further include one or more rubber or plastic layers. For example, a surface of the locking plate 150 that contacts the frame of the firearm may be lined completely or partially by a layer of rubber to protect the surface of the frame.

Figure 7:
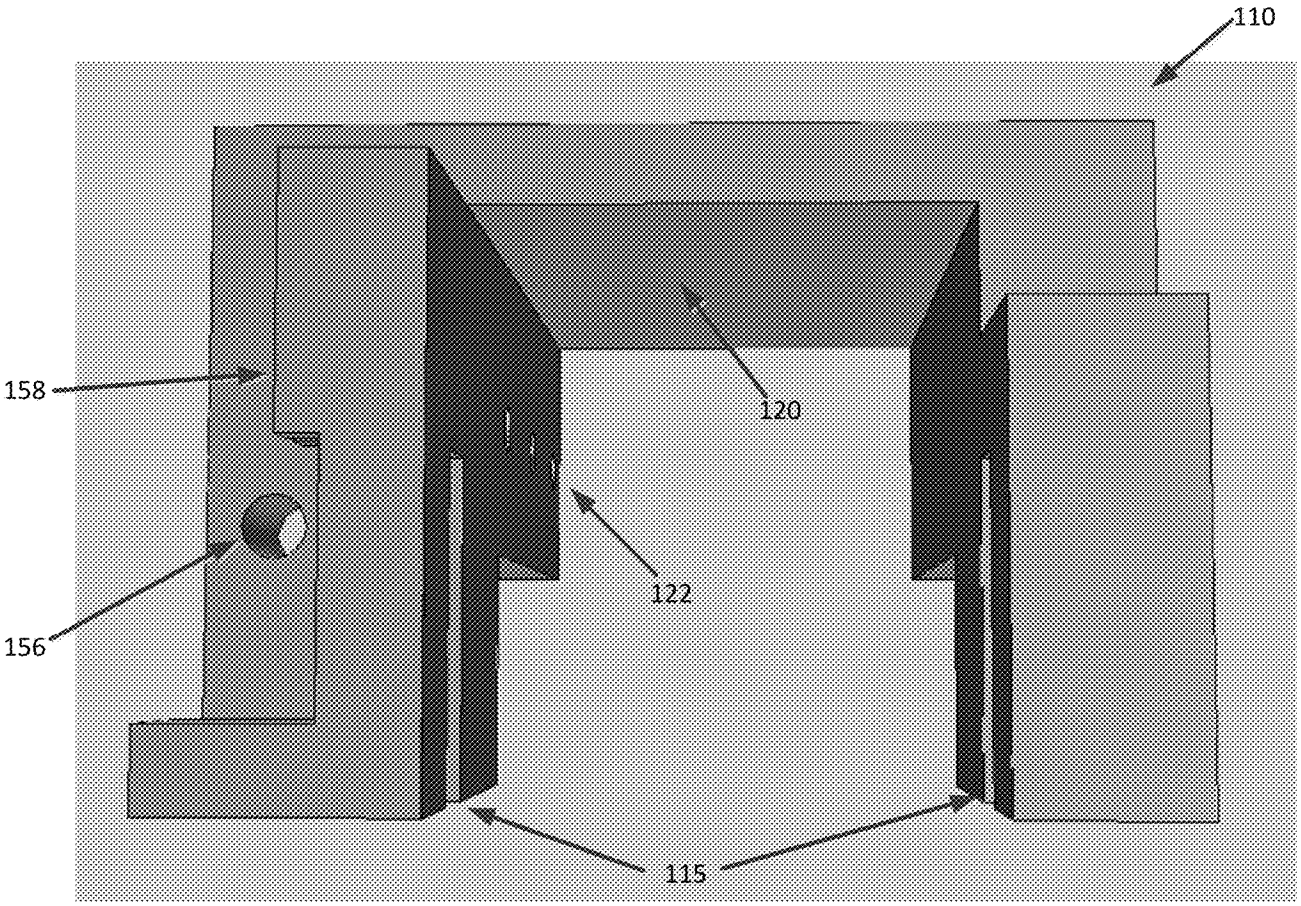
FIG. 7 depicts an example portion of a bolt-action conversion device, according to an implementation.

FIG. 7 depicts a slide clamp 110 that may be coupled to a slide of a firearm and a locking plate as part of a bolt-action conversion device, according to an embodiment. The slide clamp 110 may be the same or similar to the slide clamp 110 described with references to bolt-action conversion devices in other Figures herein.

The slide clamp 110 comprises a number of screw holes 122 to receive securing screws to couple the slide clamp 110 to a slide of a firearm. The slide clamp 110 also includes a pivot pin hole 155 to receive a pivot pin that couples a locking plate to a slide clamp 110. Receiving slots 115 a shaped to receive a locking plate as discussed with reference to FIGS. 1-3 above. A torsion spring retainer 158 receives an arm of a torsion spring. The torsion spring may then apply a force to the slide clamp 110 and a locking plate to position the locking plate in the receiving slots 115. In some embodiments, the bolt-action conversion device may operate without a torsion spring and the locking plate may be positioned manually into the receiving slots 115.

The perspective of FIG. 7 is along a longitudinal cavity formed by the shape of an interior surface 120 of the slide clamp 110. The cavity may be configured to be a particular shape such that a slide of a firearm fits into the cavity. The receiving slots 115 may aligned such that they are substantially orthogonal to the longitudinal cavity. The receiving slots 115 may also be positioned substantially adjacent to the forward end of the slide clamp 110. Thus, a locking plate inserted into the receiving slots may be positioned at the front of a frame of a firearm.

In some embodiments, the slide clamp 110 may include a channel along the interior surface of the clamp that may be positioned to provide an unobstructed view of a firearm's sights. For example, the channel may provide a view of the front and rear sights of a firearm. In some embodiments, a channel may instead be positioned on the exterior surface of a slide clamp 110 to enable viewing of the firearm sights above the slide clamp 110. In some embodiments, the slide clamp 110 may include sights on the front or rear that can be used for targeting the firearm. The slide clamp 110 may be made of steel, aluminum, a plastic or ceramic composite material, or any other suitable material. In addition to the structure shown, in some embodiments, the slide clamp 110 may further include one or more rubber or plastic layers. For example, the interior surface 120 may be lined completely or in part by a layer to protect the surface of the firearm slide.

Figure 8:
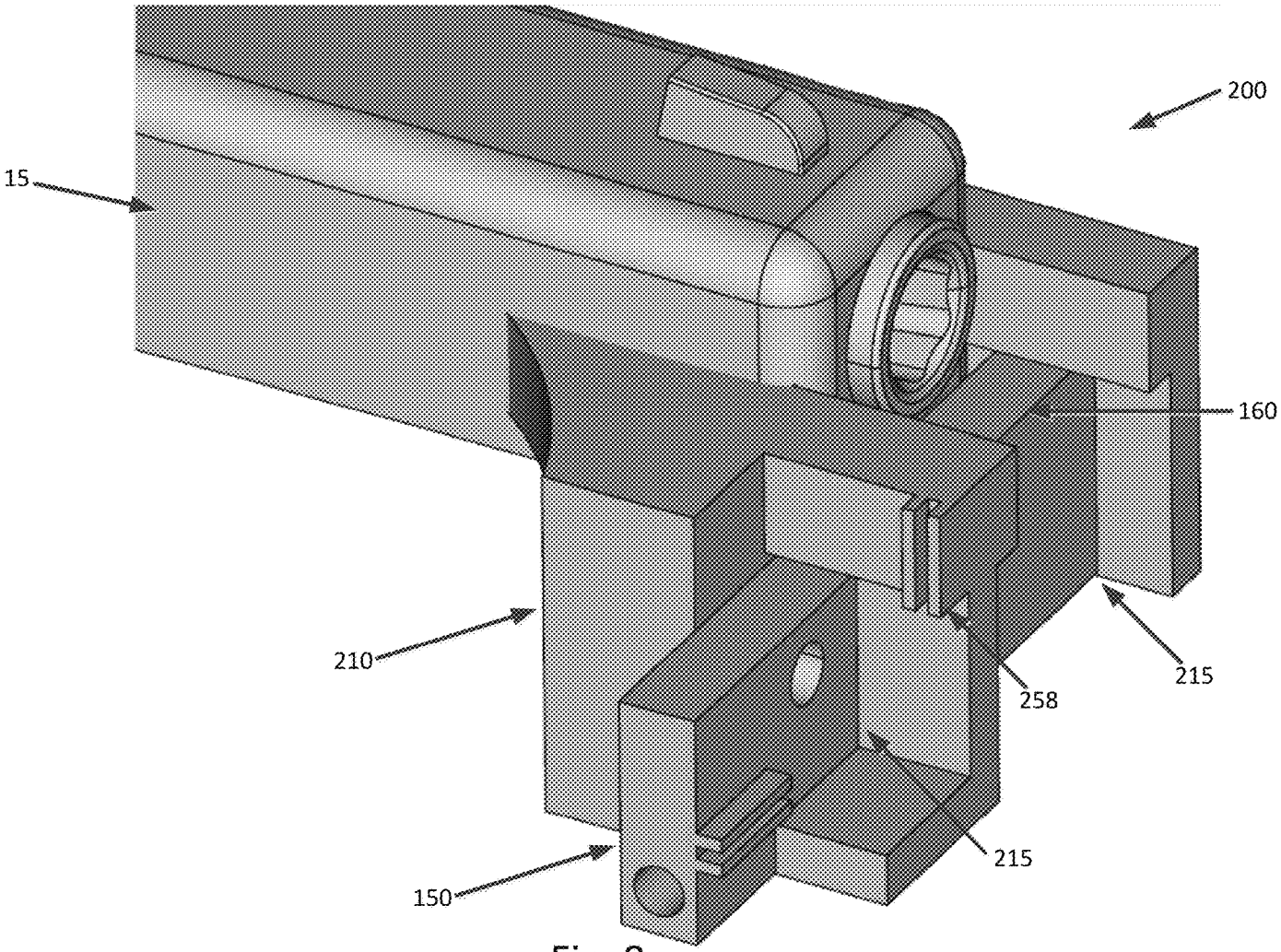
FIG. 8 depicts an example bolt-action conversion device coupled to a firearm, according to an implementation.

FIG. 8 depicts an example bolt-action conversion device 200 coupled to a firearm, according to an embodiment. Rather than a slide clamp as described with reference to FIGS. 1-7, the bolt-action conversion device 200 in FIG. 8 may have a locking plate retainer 210 that is integral to the slide 15 of a firearm. In FIG. 8, the locking plate 150 may be the same or similar to the locking plate 150 described with reference to the previous figures.

The locking plate retainer 210 may include a torsion spring retainer 258, receiving slots 215, a pivot pin hole (not shown) and other features analogous to those described with reference to the slide clamp 110 above. The receiving slots 115 of the locking plate retainer 210 may position the locking plate 150 in front of a frame of a firearm without obstructing the barrel 25 of the firearm. Accordingly, the locking plate 150 may stop the slide 15 of the firearm from sliding in response to the firing of a bullet from the firearm. The slide 15 of the firearm may be operated in the same manner as the locking plate 150 described above with reference to FIGS. 1-3 to open and close the chamber of the firearm. However, rather than providing force to a slide clamp to operate the slide, the locking plate 150 may provide force to the locking plate retainer 210.

In the description herein, numerous specific details are set forth, such as examples of specific types of processors and system configurations, specific hardware structures, specific architectural and micro architectural details, specific register configurations, specific instruction types, specific system components, specific measurements/heights, specific processor pipeline stages and operation etc. in order to provide a thorough understanding of the present disclosure. It will be apparent, however, that these specific details need not be employed to practice the present disclosure. In other instances, well known components or methods, such as specific and alternative processor architectures, specific logic circuits/code for described algorithms, specific firmware code, specific interconnect operation, specific logic configurations, specific manufacturing techniques and materials, specific compiler implementations, specific expression of algorithms in code, specific power down and gating techniques/logic and other specific operational details of computer system have not been described in detail in order to avoid unnecessarily obscuring the present disclosure.

Use of the phrase 'configured to,' in one implementation, refers to arranging, putting together, manufacturing, offering to sell, importing and/or designing an apparatus, hardware, logic, or element to perform a designated or determined task. In this example, an apparatus or element thereof that is not operating is still 'configured to' perform a designated task if it is designed, coupled, and/or interconnected to perform said designated task. Note once again that use of the term 'configured to' does not require operation, but instead focuses on the latent state of an apparatus, system, and/or element, where in the latent state the apparatus, system, and/or element is designed to perform a particular task when the apparatus, system, and/or element is operating.

Furthermore, use of the phrases 'to,' 'capable of/to,' and or 'operable to,' in one implementation, refers to some apparatus, system, and/or element designed in such a way to enable use of the apparatus, system, and/or element in a specified manner. Note as above that use of to, capable to, or operable to, in one implementation, refers to the latent state of an apparatus, logic, hardware, and/or element, where the apparatus, logic, hardware, and/or element is not operating but is designed in such a manner to enable use of an apparatus in a specified manner.

Reference throughout this specification to "one implementation" or "an implementation" means that a particular feature, structure, or characteristic described in connection with the implementation is included in at least one implementation of the present disclosure. Thus, the appearances of the phrases "in one implementation" or "in an implementation" on "in some implementations" in various places throughout this specification are not necessarily all referring to the same implementation. Furthermore, the particular features, structures, or characteristics may be combined in any suitable manner in one or more implementations.

In the foregoing specification, a detailed description has been given with reference to specific exemplary implementations. It will, however, be evident that various modifications and changes may be made thereto without departing from the broader spirit and scope of the disclosure as set forth in the appended claims. The specification and drawings are, accordingly, to be regarded in an illustrative sense rather than a restrictive sense. Furthermore, the foregoing use of implementation and other exemplarily language does not necessarily refer to the same implementation or the same example, but may refer to different and distinct implementations, as well as potentially the same implementation.

The words "example" or "exemplary" are used herein to mean serving as an example, instance or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an implementation" or "one implementation" or "an implementation" or "one implementation" throughout is not intended to mean the same implementation or implementation unless described as such. Also, the terms "first," "second," "third," "fourth," etc. as used herein are meant as labels to distinguish among different elements and may not necessarily have an ordinal meaning according to their numerical designation.

What is claimed is:

1. An apparatus comprising: a slide clamp having a longitudinal cavity and a first pin hole, wherein the slide clamp further comprises a receiver in a direction orthogonal to the longitudinal cavity and substantially adjacent to a forward end of the slide clamp; and a locking plate having a body portion and a second pin hole, wherein the body portion comprises a narrow dimension and a broad dimension relative to the narrow dimension, wherein, when the locking plate is inserted into the receiver of the slide clamp with the first pin hole and the second pin hole aligned, an opening is formed between an upper surface of the narrow dimension of the locking plate and an internal surface of the longitudinal internal cavity, and wherein the longitudinal cavity is configured to accept a slide of a firearm such that the opening is aligned with a barrel of the firearm and at least a portion of the locking plate is aligned with a frame of the firearm; and wherein the locking plate further comprises a charging handle, wherein the charging handle is configured to pivot the locking plate about an axis defined by the second pin hole when a pivot pin is inserted into the first pin hole and the second pin hole.

2. The apparatus of claim 1, further comprising the pivot pin is configured to fit in the first pin hole and second pin hole.

3. The apparatus of claim 1, wherein:

the slide clamp further comprises a first torsion spring retainer and the locking plate further comprises a second torsion spring retainer; and wherein a torsion spring fitted into the first torsion spring retainer and the second torsion spring retainer is configured to apply a force to insert the locking plate into the receiver.

4. The apparatus of claim 1, wherein the receiver is a tapered slot that is wider at an opening of the receiver.

5. The apparatus of claim 1, wherein the slide clamp further comprises a first retaining plate coupled to the slide clamp in the direction of the longitudinal cavity, wherein the retaining plate is configured to secure the slide clamp to the slide of the firearm.

6. The apparatus of claim 1, wherein the slide clamp further comprises a channel on the interior surface of the slide clamp that is configured to align with the sights of a firearm when the slide clamp is coupled to a firearm.

7. An apparatus comprising:

a slide clamp having a longitudinal cavity and a first pin hole, wherein the slide clamp further comprises a receiver in a direction orthogonal to the longitudinal cavity and substantially adjacent to a forward end of the slide clamp; and a locking plate having a body portion and a second pin hole, wherein, when the locking plate is inserted into the receiver of the slide clamp with the first pin hole and the second pin hole aligned, an opening is formed between an upper surface of the body portion of the locking plate and an internal surface of the longitudinal internal cavity, and wherein the longitudinal cavity is configured to accept a slide of a firearm such that the opening is aligned with the barrel of the firearm and at least a portion of the locking plate is aligned with a frame of the firearm;

further comprising a pivot pin configured to fit in the first pin hole and the second pin hole; and wherein the pivot pin is oriented parallel to the longitudinal cavity of the slide clamp.

8. The apparatus of claim 7, wherein:

the slide clamp further comprises a first torsion spring retainer and the locking plate further comprises a second torsion spring retainer; and wherein a torsion spring fitted into the first torsion spring retainer and the second torsion spring retainer is configured to apply a force to insert the locking plate into the receiver.

9. The apparatus of claim 7, wherein the receiver is a tapered slot that is wider at an opening of the receiver.

10. The apparatus of claim 7, wherein the slide clamp further comprises a first retaining plate coupled to the slide clamp in the direction of the longitudinal cavity, wherein the retaining plate is configured to secure the slide clamp to the slide of the firearm.

11. The apparatus of claim 10, wherein the retaining plate is constructed of a rubber or plastic material.

12. The apparatus of claim 7, wherein the locking plate further comprises a charging handle, wherein the charging handle is configured to pivot the locking plate about an axis defined by the second pin hole when a pivot pin is inserted into the first pin hole and the second pin hole.

13. The apparatus of claim 7, wherein the slide clamp further comprises a channel on the interior surface of the slide clamp that is configured to align with the sights of a firearm when the slide clamp is coupled to a firearm.

14. An apparatus comprising:

a firearm slide comprising a locking plate retainer, the locking plate retainer comprising a first pin hole and a receiver in a direction orthogonal to a longitudinal cavity of the locking plate retainer, wherein the locking plate retainer is substantially adjacent to a forward end of the locking plate retainer; and a locking plate having a body portion and a second pin hole, wherein the body portion comprises a narrow dimension and a broad dimension relative to the narrow dimension, wherein, when the locking plate is inserted into the receiver of the locking plate retainer with the first pin hole and the second pin hole aligned, an opening is formed between an upper surface of the narrow dimension of the locking plate and an internal surface of the longitudinal internal cavity, wherein the longitudinal cavity is configured as part of a slide of a firearm such that the opening is aligned with a barrel of the firearm and at least a portion of the locking plate is aligned with a frame of the firearm; and wherein the locking plate further comprises a charging handle, wherein the charging handle is configured to pivot the locking plate about an axis defined by the second pin hole when a pivot pin is inserted into the first pin hole and the second pin hole.

15. The apparatus of claim 14, wherein:

the locking plate retainer further comprises a first torsion spring retainer and the locking plate further comprises a second torsion spring retainer; and wherein a torsion spring fitted into the first torsion spring retainer and the second torsion spring retainer is configured to apply a force to insert the locking plate into the receiver.

16. The apparatus of claim 14, wherein the receiver is a tapered slot that is wider at an opening of the receiver.

* * * * *